US010898917B2

(12) United States Patent
Meier et al.

(10) Patent No.: US 10,898,917 B2
(45) Date of Patent: Jan. 26, 2021

(54) INSULATION DEVICE AND COATING SYSTEM COMPRISING SAID INSULATION DEVICE

(71) Applicant: EISENMANN SE, Böblingen (DE)

(72) Inventors: Ralph Meier, Waldenbuch (DE); Jan Reichler, Constance (DE)

(73) Assignee: EISENMANN SE, Böblingen (DE)

( * ) Notice: Subject to any disclaimer, the term of this patent is extended or adjusted under 35 U.S.C. 154(b) by 0 days.

(21) Appl. No.: 16/076,427

(22) PCT Filed: Feb. 10, 2017

(86) PCT No.: PCT/EP2017/053009

§ 371 (c)(1),
(2) Date: Aug. 8, 2018

(87) PCT Pub. No.: WO2017/137562

PCT Pub. Date: Aug. 17, 2017

(65) Prior Publication Data

US 2019/0047005 A1 Feb. 14, 2019

(30) Foreign Application Priority Data

Feb. 10, 2016 (DE) ..... 10 2016 001 544

(51) Int. Cl.
*B05B 12/14* (2006.01)
*B05B 5/16* (2006.01)

(52) U.S. Cl.
CPC ..... *B05B 12/1481* (2013.01); *B05B 5/1633* (2013.01)

(58) Field of Classification Search
None
See application file for complete search history.

(56) References Cited

U.S. PATENT DOCUMENTS 4,077,080 A * 3/1978 Ross ..... B08B 9/0553 15/104.061
5,083,711 A * 1/1992 Giroux ..... B05B 5/1625 239/690

(Continued)

FOREIGN PATENT DOCUMENTS

CN 13 28 881 A 1/2002
CN 18 26 717 A 8/2006

(Continued)

OTHER PUBLICATIONS

English translation of Written Opinion of PCT/EP2017/053009 (WO2017137562) corresponding to U.S. Appl. No. 16076427.*
English translation for DE19926514.*

*Primary Examiner* — Charles Capozzi
(74) *Attorney, Agent, or Firm* — Schroeder Intellectual Property Law Group, LLC

(57) ABSTRACT

An insulation device for a coating system for coating objects, the coating system having an electrostatically operating application apparatus having a dispensing device which dispenses a coating material, and at least one storage container which is connected to an input valve device via an inlet line and to the dispensing device via a supply line. The insulation device comprises a channel with a physical body which can move in the channel. The physical body has an electrically insulating material and can be moved by means of a fluid pressure between a park position and an insulation position and is designed such that, when it moves from the park position to the insulation position or from the insulation position to the park position, the physical body removes material from an inner casing surface of the channel, so that an electrical insulation path can be formed between the storage container and the input valve device.

7 Claims, 11 Drawing Sheets

(56) References Cited

U.S. PATENT DOCUMENTS

| | | | | |
|---|---|---|---|---|
| 5,096,126 | A | 3/1992 | Giroux et al. | |
| 5,255,856 | A | 10/1993 | Ishibashi et al. | |
| 5,364,035 | A | 11/1994 | Ma et al. | |
| 5,630,552 | A | 5/1997 | Anfindsen et al. | |
| 6,471,778 | B1 | 10/2002 | Baltz et al. | |
| 7,296,756 | B2 | 11/2007 | Scharfenberger | |
| 7,549,449 | B2 | 6/2009 | Herre et al. | |
| 7,572,488 | B2 | 8/2009 | Huehsam | |
| 7,891,589 | B2 | 2/2011 | Reichler | |
| 8,322,301 | B2 | 12/2012 | Nakazono et al. | |
| 8,689,730 | B2 | 4/2014 | Clifford | |
| 9,366,372 | B2 | 6/2016 | Nakazono et al. | |
| 10,220,402 | B2 | 3/2019 | Fleisch et al. | |
| 2006/0019036 | A1* | 1/2006 | Herre ..... | B05B 5/1625 427/421.1 |
| 2006/0177593 | A1 | 8/2006 | Huehsam | |
| 2006/0273185 | A1 | 12/2006 | Scharfenberger | |
| 2010/0043703 | A1 | 2/2010 | Reichler | |
| 2010/0163638 | A1 | 7/2010 | Herre et al. | |
| 2010/0196616 | A1 | 8/2010 | Clifford | |
| 2014/0217721 | A1 | 8/2014 | Nakazono et al. | |
| 2017/0216868 | A1 | 8/2017 | Fleisch et al. | |

FOREIGN PATENT DOCUMENTS

| | | | |
|---|---|---|---|
| CN | 102 413 944 | A | 4/2012 |
| CN | 102 458 688 | B | 7/2015 |
| DE | 3821006 | C1 | 7/1989 |
| DE | 1136674 | A1 | 5/1992 |
| DE | 4427704 | A1 | 6/1995 |
| DE | 69226376 | T2 | 4/1999 |
| DE | 199 26 514 | | 12/2000 |
| DE | 19937426 | A1 | 3/2001 |
| DE | 19961270 | A1 | 7/2001 |
| DE | 19961271 | A1 | 7/2001 |
| DE | 10033987 | A1 | 1/2002 |
| DE | 10131562 | A1 | 1/2003 |
| DE | 10157966 | A1 | 6/2003 |
| DE | 102004056789 | A1 | 6/2006 |
| DE | 102004058053 | A1 | 6/2006 |
| DE | 102005001765 | A1 | 7/2006 |
| DE | 10 2014 011 415 | A1 | 2/2016 |
| EP | 0 434 535 | | 6/1991 |
| EP | 1666158 | A2 | 11/2005 |
| EP | 1 726 367 | B1 | 11/2006 |
| GB | 2458841 | A | 10/2009 |
| TW | I 321494 | B | 3/2010 |
| WO | 9323173 | | 11/1993 |
| WO | 03095106 | A2 | 11/2003 |
| WO | 2016015866 | A1 | 2/2016 |

* cited by examiner

INSULATION DEVICE AND COATING SYSTEM COMPRISING SAID INSULATION DEVICE

RELATED APPLICATIONS

This application is a national phase of International Patent Application No. PCT/EP2017/053009 filed Feb. 10, 2017, which claims priority to German Patent Application No. 10 2016 001 544.6 filed Feb. 10, 2016, the contents of both of which are incorporated herein by reference.

BACKGROUND OF THE INVENTION

1. Field of the Invention

The invention relates to an insulation device and to a coating system for coating objects, wherein the coating system comprises an electrostatically operating application apparatus having a dispensing device by means of which a coating material is able to be dispensed, and at least one feed reservoir for coating material, which is connected to an input valve device via an inlet line and to the dispensing device via a supply line.

2. Description of the Prior Art

With such coating systems, in the automotive industry, for example, objects such as vehicle bodies or body parts are coated with the aid of the electrostatically operating application device. In this case, the coating material, for example a paint, is dispensed by the dispensing device and exposed to an electric field. In the electric field, the dispensed coating material is ionized and transported by means of electrostatic forces to the object to be coated. Usually, the object is at ground potential in this case. Such an application device can be for example a high-speed rotary atomizer, in which the dispensing device comprises a rotating bell-shaped plate from which extremely small paint droplets are thrown. The resultant paint mist is ionized in the electric field and as a result transported to the object to be coated.

In practice, the input valve device can be for example what is known as a color changer which is fed with different media from ring lines. If for example the hue is intended to be changed between two coating operations, the dispensing device has to be supplied with a different coating material. In order for it to be possible to carry out such a color change in a time-efficient manner, two supply strings are frequently provided in modern coating systems. In this way, it is possible, during a coating operation, to feed the application device with a first coating material from one supply string and at the same time to prepare a second supply string with a second coating material. This reduces the color changing time.

In the electrostatically operating systems mentioned at the beginning, potential separation has to be established and maintained between the application apparatus and the rest of the coating system during the coating operation. To this end, the lines leading away from the application device have to be clean and dry at least along a sufficiently long portion. The lines themselves are accordingly manufactured from an electrically insulating material.

For cleaning, the corresponding line portions are cleaned with a detergent and subsequently blown dry with compressed air in order to establish an electrical insulation section.

It is an object of the invention to specify an insulation device and a coating system of the type mentioned at the beginning, with the aid of which such an insulation section can be produced effectively.

SUMMARY OF THE INVENTION

This object is achieved by an insulation device for a coating system for coating objects, wherein the coating system has an electrostatically operating application apparatus having a dispensing device by means of which a coating material is able to be dispensed, and at least one feed reservoir for coating material, which is connected to an input valve device via an inlet line and to the dispensing device via a supply line. The insulation device has a duct having a clearing body that is movable in the duct, the clearing body having an electrically insulating material and being movable between a parked position and an insulation position. The clearing body is configured such that, while moving from the parked position to the insulation position or from the insulation position to the parked position, the clearing body frees an inner lateral surface of the duct of material such that an electrical insulation section is able to be formed between the feed reservoir and the input valve device. The clearing body is movable by means of a fluid pressure, and the clearing body has an insulation portion for electrical insulation and a line portion for a material line. Further configurations of the invention are specified herein.

The insulation device according to the invention is provided for a coating system for coating objects, wherein the coating system comprises an electrostatically operating application apparatus having a dispensing device by means of which a coating material is able to be dispensed, and at least one feed reservoir for coating material, wherein the feed reservoir is connected to an input valve device via an inlet line and to the dispensing device via a supply line.

The insulation device comprises a duct having a clearing body that is movable in the duct. The clearing body has an electrically insulating material and is movable between a parked position and an insulation position.

According to the invention, the clearing body is movable by means of a fluid pressure and is configured such that, while moving from the parked position to the insulation position or from the insulation position to the parked position, it frees an inner lateral surface of the duct of material such that an electrical insulation section is able to be formed between the feed reservoir and the input valve device.

If the clearing body is moved between the parked position and the insulation position or vice versa, an electrical insulation section can already be established by this clearing movement together with the electrically insulating material of the clearing body. The movement of the clearing body can in this case advantageously be brought about only by a fluid pressure.

The fluid moving the clearing body can be understood to be for example a coating material, an insulation material, a flushing material or compressed air. The fluid pressure can be transmitted to the clearing body for example by direct contact between the fluid and clearing body or by indirect contact, for example by a pig body which comes into contact with the clearing body and is itself exposed to the fluid pressure.

The clearing body has an insulation portion for electrical insulation and a line portion for a material line. As a result of the division into an insulation portion and a line portion, the clearing body can, in a first position, for example the insulation position, produce an insulation section with the insulation portion and thus form a potential separation. In a second position, for example the parked position, by contrast, the clearing body can allow, with the line portion, coating material, for example, to be conducted through the clearing body.

In this connection, it may be advantageous for the clearing body to have a longitudinal axis in the direction of movement, and for the insulation portion and line portion to be arranged along this longitudinal axis. In this way, a movement of the clearing body along the longitudinal axis makes it possible, depending on the position of the clearing body, for the clearing body to realize an insulation function in one case and a conducting function in the other case.

In one development of the invention, the insulation portion defines an insulation space in the duct. If the clearing body moves into the insulation position, the inner lateral surface of the duct can be cleared of possibly conductive material. Otherwise, the clearing body forms, with its insulation portion in the insulation position within the duct, an insulation space which allows potential separation.

In this connection, it may be particularly advantageous for the insulation space to be fillable with an insulation material. As insulation material, it is possible to use for example air, esters or vegetable oils, petroleum jelly or phenyl (C10-C21)alkanesulfonate, a mixture of different alkylsulfonates of phenol that are sold under the trade names Mesamoll and Mesamoll II.

In one development of the invention, provision may be made for the line portion to have a coating-material line. In this way, it is possible to conduct coating material through the clearing body, in particular through the coating-material line. This can be provided in particular in the parked position of the clearing body. In this position, provision may be made for the clearing body for example not to provide any potential separation.

In this connection, provision may be made for the coating-material line to have a first line connection located radially with respect to the direction of movement and a second line connection located at an end side of the clearing body. In this case, the clearing body can have for example a cylindrical basic shape. With such a basic shape, the first line connection can be arranged for example on the outer circumference of the cylindrical basic shape. In this way, it is possible for coating material, for example, to be able to be fed to the clearing body for example via the first line connection that is accessible at its outer circumference and to be able to be dispensed again via the second line connection located at the end side. Of course, the direction of flow can also be the other way. Rather than a coating material, it is also possible for some other fluid which requires potential separation to be feedable and dischargeable via the first and the second line connection.

In this connection, in one development of the invention, provision may be made, in the insulation position, for the radial line connection to allow a line connection between the coating-material line and the feed reservoir and/or the end-side line connection to allow a line connection between the coating-material line and the dispensing device. This makes it possible, in the insulation position, for coating material, for example, to be introduced via the line portion of the clearing body, while the insulation portion allows potential separation between the application apparatus and the rest of the coating system.

The object is also achieved by a coating system for coating objects having an electrostatically operating application apparatus having a dispensing device by means of which a coating material is able to be dispensed, and at least one feed reservoir for coating material, which is connected to an input valve device via an inlet line and to the dispensing device via a supply line. The coating system comprises an insulation device having a duct having a clearing body that is movable in the duct, the clearing body having an electrically insulating material and being movable between a parked position and an insulation position. The clearing body is configured such that, while moving from the parked position to the insulation position or from the insulation position to the parked position, the clearing body frees an inner lateral surface of the duct of material such that an electrical insulation section is able to be formed between the feed reservoir and the input valve device. The clearing body is movable by means of a fluid pressure, and the clearing body has an insulation portion for electrical insulation and a line portion for a material line.

The coating system according to the invention for coating objects comprises an electrostatically operating application apparatus having a dispensing device by means of which a coating material is able to be dispensed, and at least one feed reservoir for coating material, which is connected to an input valve device via an inlet line and to the dispensing device via a supply line. According to the invention, the coating system comprises an insulation device as described above.

BRIEF DESCRIPTION OF THE DRAWINGS

Exemplary embodiments of the invention are explained in more detail in the following text with reference to the drawings, in which.

DESCRIPTION OF PREFERRED EXEMPLARY EMBODIMENTS

1. Basic Structure of the Coating System

Figure 1:
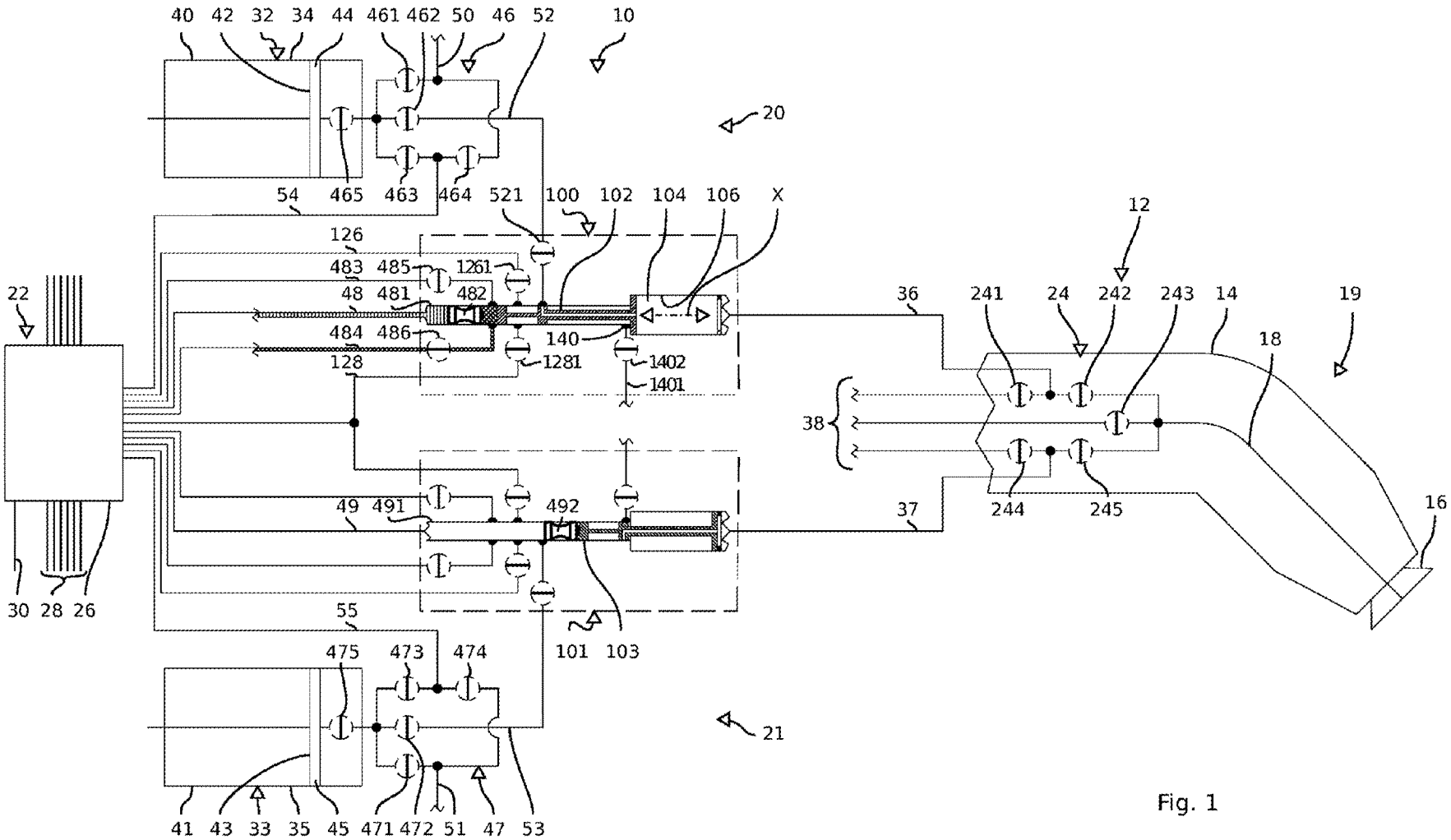
FIG. 1 shows a schematic illustration of a coating system having insulation devices according to the invention.

FIG. 1 shows a schematic illustration of a coating system 10 for coating objects, such as vehicle bodies or attachments therefor, for example, which are not specifically shown.

The coating system 10 comprises an electrostatically operating application apparatus 12 (shown only schematically), which, in the exemplary embodiment shown in the figures, is configured as a high-speed rotary atomizer 14 having a rotating bell-shaped plate 16.

The application apparatus 12 comprises a dispensing line 18, via which coating material can be dispensed onto an object. In the exemplary embodiment shown in FIG. 1, the dispensing line 18 leads to the bell-shaped plate 16 of the high-speed rotary atomizer 14. The bell-shaped plate 16 and the dispensing line 18 thus form a dispensing device 19.

The application apparatus 12 can be supplied with coating material selectively from two supply strings 20, 21. In the figures, a first supply string 20 and a second supply string 21 of identical construction are provided. The two supply strings 20, 21 extend between an input valve device 22 and an output valve device 24.

In the exemplary embodiment shown in the figures, the input valve device 22 is configured as a color changer 26, which can be fed with different media from ring lines 28. The input valve device 22 is furthermore connected to a working line 30, via which a working fluid, such as compressed air or a detergent, for example, can be fed. The working line 30 can serve at the same time as a drainage line for discharging material from the system. Alternatively, it is also possible for a separate drainage line to be provided for this purpose. To this end, the working line 30 can be connected to a valve device (not shown specifically), which can connect the working line 30 to a compressed-air source, a detergent source and/or an outlet. Where further lines are referred to as working lines in the following text, these fulfill the same purpose in an analogous manner and, depending on the requirements, are connected to a corresponding valve device and material sources and to an outlet.

The input valve device 22 can—as illustrated in FIG. 1—be configured in an integral manner. In one variant, a separate input valve device or input valve devices divided into even smaller parts are conceivable for each supply string.

Each supply string 20, 21 comprises a feed reservoir 32, 33 in the form of a piston metering device 34, 35, from which the application apparatus 12 can be fed via a supply line 36, 37. The piston metering device 34, 35 represents only an example of a feed reservoir 32, 33 for coating material.

In order to connect the dispensing device 19 of the application apparatus 12 to the supply strings 20, 21 and specifically to the piston metering devices 34, 35 thereof in the present exemplary embodiment, the dispensing line 18 is connected to an output valve device 24, into which the respective supply line 36, 37 of each supply string 20, 21 also leads. The output valve device 24 can furthermore be connected to working lines 38 for compressed air/detergent/drainage and has appropriately assigned valves 241-245 for controlling the different lines and line portions located within the output valve device 24.

The piston metering devices 34, 35 each comprise a cylinder 40, 41, in each of which a piston 42, 43 can be moved in each case with the aid of a piston drive (not illustrated specifically). The pistons 42, 43 each delimit with the cylinders 40, 41 a working chamber 44, 45. Each working chamber 44, 45 is connected to its associated supply line 36, 37 in each case via a metering-device valve unit 46, 47. The metering-device valve units 46, 47 each have valves 461-465 and 471-475, respectively, for the corresponding lines and line portions. The metering-device valve unit 46, 47 can be configured as a structural unit with the piston metering device 34, 35, in order to represent a compact and lightweight component with short line lengths.

Furthermore, each working chamber 44, 45 is connected in each case to an inlet line 48, 49 via the respective metering-device valve unit 46, 47. Moreover, in each case a first working line 50, 51, which can serve for example as a discharge line, and a second working line 54, 55, which, as illustrated in the figures, can each be connected to the color changer 26, lead into the respective metering-device valve unit 46, 47. The first and the second working line can serve for example for compressed air/detergent or as a drainage line.

The inlet lines 48, 49 each extend between the color changer 26 and the respective piston metering device 34, 35 and can for example each comprise a piggable line portion 481, 491. A pig 482, 492 is illustrated in each of the piggable line portions 481, 491 in the figures.

In order to establish an insulation section between the color changer 26 and the application apparatus 12, an insulation device 100, 101 is provided in each case between the feed reservoirs 32, 33, in particular the piston metering devices 34, 35, for the one part, and the application apparatus 12, for the other part. In the exemplary embodiments shown in the figures, each insulation device 100, 101 is connected to the application apparatus 12 via the respective supply line 36, 37, to the respective piston metering device 34, 35, in particular the respective metering-device valve unit 46, 47, via in each case one coating-material dispensing line 52, 53, and to the color changer 26 via the respective inlet line 48, 49. In addition to the abovementioned connections, the insulation devices 100, 101 each have further connections to working lines and/or insulation material, as will be explained in more detail below. Each insulation device 100, 101 can likewise form a structural unit with the respective piston metering device 34 and optionally with the respective metering-device valve unit 46, 47. This allows, as already mentioned, a particularly short line run and a compact and lightweight design, which for example attachment to a lower arm of an articulated robot (in conjunction with attachment, separate from the piston metering device, of the application device 19 to the wrist of such an articulated robot).

Figure 2:
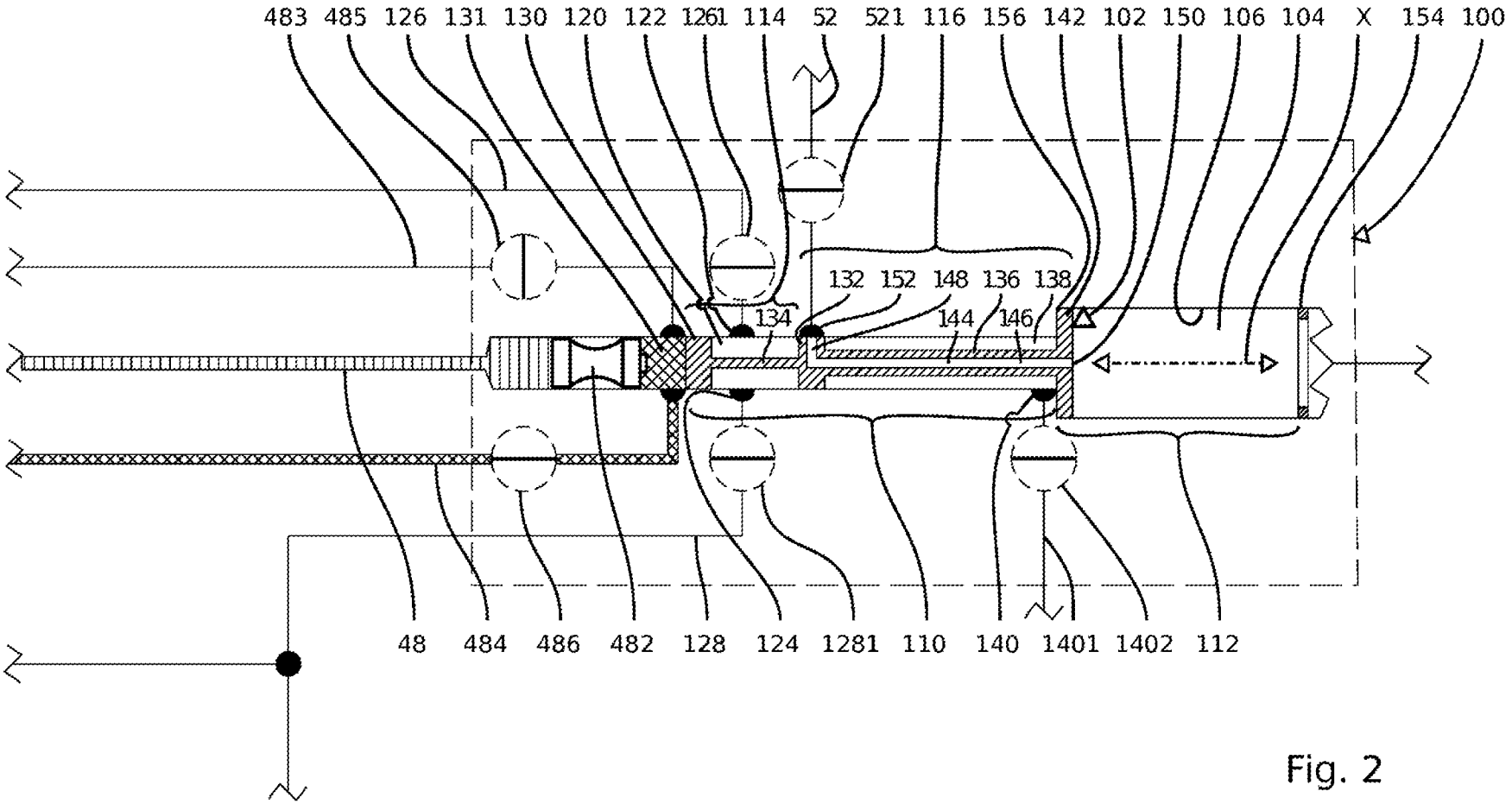
FIG. 2 shows an enlarged illustration of the insulation devices in FIG. 1.

FIG. 2 shows an enlarged illustration of the insulation device 100.

In order to simplify the description, only the insulation device 100 is described in detail in FIG. 2. The statements also apply in an analogous manner to the second insulation device 101, however.

The insulation device 100 comprises a clearing body 102, which can be moved back and forth in a direction of movement X in a duct 104 with an inner lateral surface 106. The clearing body 102 is shown in a sectional illustration in FIGS. 1-3.

In the embodiment shown in the figures, the duct 104 has two different cross sections in the direction of movement X. An insulation region 110—illustrated by way of a curly bracket—provided with a for example smaller cross-sectional area is followed in the direction of movement X by a line region 112 provided with a larger cross-sectional area, likewise indicated by a curly bracket. Alternatively, other size ratios could also be provided.

The clearing body 102 is produced from an electrically insulating material and has a substantially cylindrical basic shape in its direction of movement X in the embodiment shown in the figures, said basic shape being divisible successively in the direction of movement X into an insulation portion 114 and a line portion 116—again indicated by curly brackets. The external geometry of the clearing body 102 in the insulation portion 114 and in the line portion 116 is at least regionally complementary to the internal cross section of the respective region 110, 112 of the duct 104. Of course, other complementary basic shapes are also conceivable, which can be moved with respect to one another along a particular section in a direction of movement.

In the insulation region 110 of the duct 104, an insulation space 120 is formed in the insulation portion 114 between the outer surface of the clearing body 102. The insulation space 120 is connected to feed and drain lines 126, 128 via connections 122, 124. The feed line 126 has a valve 1261, the drain line 128 a valve 1281. Via the feed line 126 and the drain line 128, the insulation space 120 can be flushed for example with a flushing medium and/or filled with an insulation material and an insulation medium can be discharged again. Usually, the insulation material is located in the insulation space 120 during the coating operation and, in the event of contamination, can be replaced via the connections 122, 124 and the associated working lines 126, 128 given an appropriate position of the valves 1261, 1281.

During a movement of the clearing body 102, the insulation portion 114 is always located in the insulation region 110 provided for example with a smaller duct cross section, while the line portion 116 of the clearing body 102 moves partly likewise into this insulation region 110 and partly in the line region 112.

In order to form the abovementioned insulation space 120, a portion 134 is located in an appropriate manner in the insulation portion 116 between a first portion 130 and a second portion 132, which both have an external contour complementary to the inner lateral surface 106, said portion 134 having a smaller cross-sectional area than the duct 104 and being configured such that the insulation space 120 can form between the external contour thereof and the inner lateral surface.

The line portion 116 of the clearing body 102 has a comparable external geometry, The portion 132 is adjoined by a portion 136 which likewise has a reduced cross-sectional area and thus likewise forms a space 138 between the outer surface of the portion 136 and the inner lateral surface 106 of the duct 104. The space 138 is likewise accessible from the outside via a connection 140 and a working line 1401 with a valve 1402. This portion 136 is adjoined by a portion 142 which is formed, with regard to its external contour, in a complementary manner to the inner lateral surface 106 of the line region 112 and thus has a larger cross-sectional area than the portions 130, 132.

The line portion 116 of the clearing body 102 has a conduit 144 which has a portion 146 extending in the direction of movement X and a portion 148 extending radially with respect to the direction of movement X. The portion 146 has a mouth 150, which connects the conduit 144 to the interior of the line region 112 of the duct 104. The radial conduit portion 148 has a connection 152, which connects the conduit 144 to the piston metering device 34, in particular the metering-device valve unit 46, via the coating-material dispensing line 52. The coating-material dispensing line 52 has a valve 521 for opening and closing the coating-material dispensing line 52.

Located in the line portion 112 of the duct 104 is a first stop 154, which limits a movement of the clearing body 102 within the duct 104 in a first direction. A second stop 156 forms the transition from the line region 112 to the insulation region 110 of the duct 104, said transition being associated with a step-form reduction in the inner cross-sectional area.

The portions 130, 132 and 142, the outer surfaces of which are complementary to the inner lateral surface 106 of the duct 104, are configured such that, between the outer surface of the portions 130, 132 and 142 and the inner lateral surface 106, it is not possible for any fluid to pass through. This can be achieved for example by suitable sealing means or by a suitable choice of the geometries of the cooperating surfaces. Should coating material still be stuck to the inner lateral surface 106 during a movement of the clearing body 102, this can be removed from the inner lateral surface 106 by the movement of the clearing body 102.

Between the end side 131, located at the opposite end from the mouth 150, and the pig body 482, which is located in the inlet line 48, an intermediate space forms which can be ventilated via lines 483, 484 with associated valves 485, 486 and can optionally be flushed or pressurized.

2. Method

The functionality of the insulation device 100 in cooperation with the coating system 10 will now be described in the following text.

In the figures, the materials located in the lines or containers are indicated as follows: air: cross-hatched, coating material: vertically hatched, detergent: obliquely hatched, and insulation medium: dotted.

First of all, reference is made to FIG. 1.

In the state shown in FIG. 1, first of all a first coating material is applied, starting from the color changer 26, via the inlet line 48, in particular via the pig line 481. Accordingly, the pig 482 moves in the pig line 481, driven by the fluid pressure of the conveyed coating material, toward the insulation device 100. Fluid, for example air, located between the pig 482 and the insulation device 100, in particular the clearing body 102, can escape from the inlet line 48 via the line 484 in an open position of the valve 486.

In the starting position shown in FIGS. 1 and 2, the valves 461-465 or 471-475 of the metering-device valve unit 46 or 47, respectively, the valves 241-245 of the output valve unit 24, the valve 521 of the coating-material dispensing line 52, the valves 1261, 1281 of the lines 126, 128, the valve 485 of the line 483, and the valve 1402 of the line 1401 at the connection 140 are closed.

Figure 3:
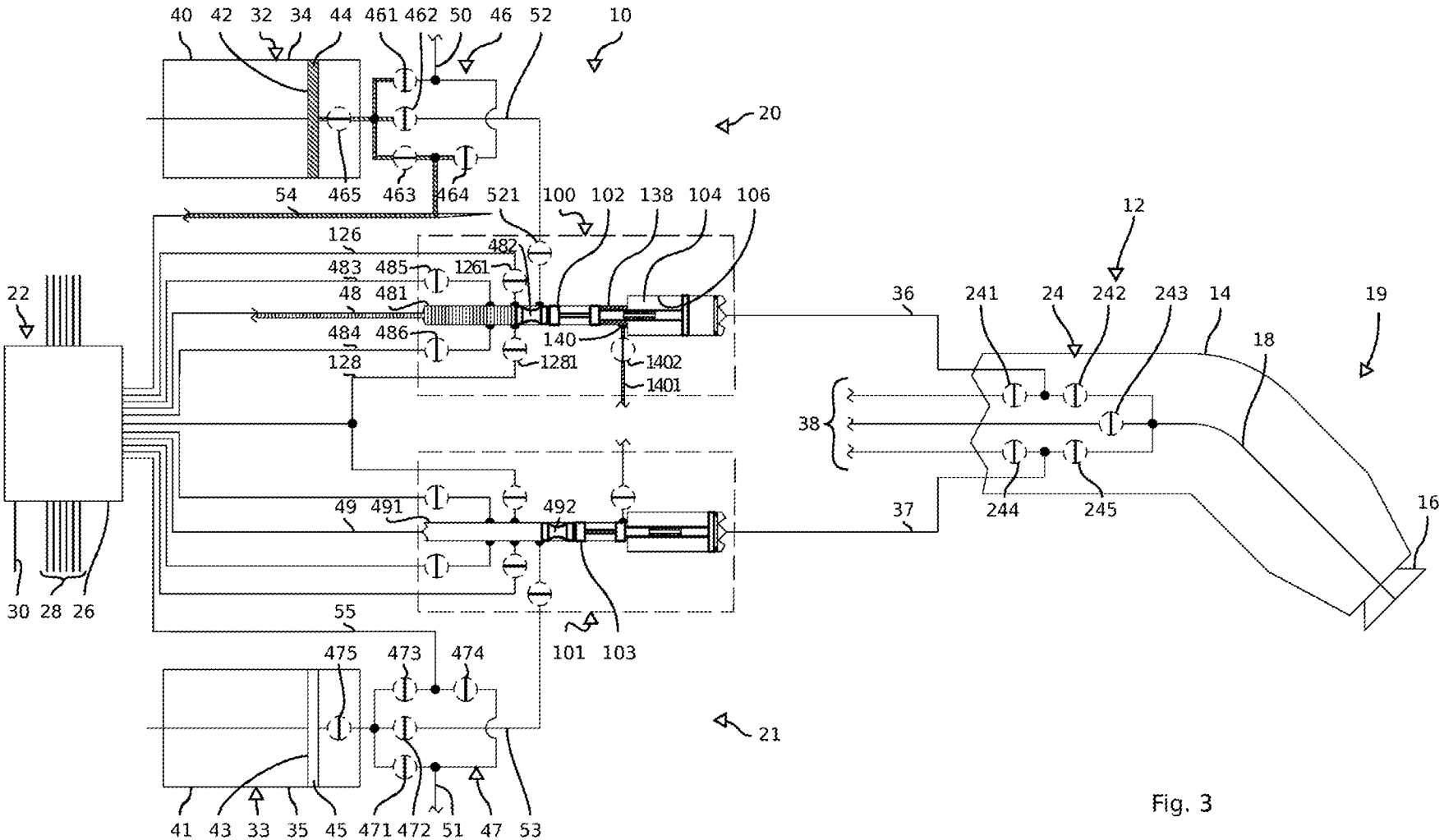
FIGS. 3-11 show different operating states of the coating system in FIG. 1.

FIG. 3 shows the coating system 10 from FIG. 1. In contrast to FIG. 1, the insulation devices 100, 101 are illustrated only partially in section.

In FIG. 3, after the ventilation operation, the valve 1281 has been closed and the coating material has been conveyed in the direction of the application device 19 to such an extent that the pig 482 has reached the clearing body 102 of the insulation device 100 and already carried it along a short distance. As a result of the movement of the clearing body 102, the space 138 becomes smaller. Any fluid carried along, for instance air, can be discharged via the connection 140 and the associated working line 1401. Accordingly, the valve 1402 is in its open position. The movement of the clearing body 102 can also additionally be supported pneumatically.

At the same time, a detergent is introduced via the working line 54 into a detergent chamber (not illustrated separately) of the piston metering device 34. To this end, the valves 463, 465 of the metering-device valve unit 46 are in an open position and the valves 461, 462, 464 of the metering-device valve unit 46 are in a closed position. This quantity of detergent can be used in a subsequent method step.

The valve position of the remaining valves of the supply string 20 remains unchanged.

Figure 4:
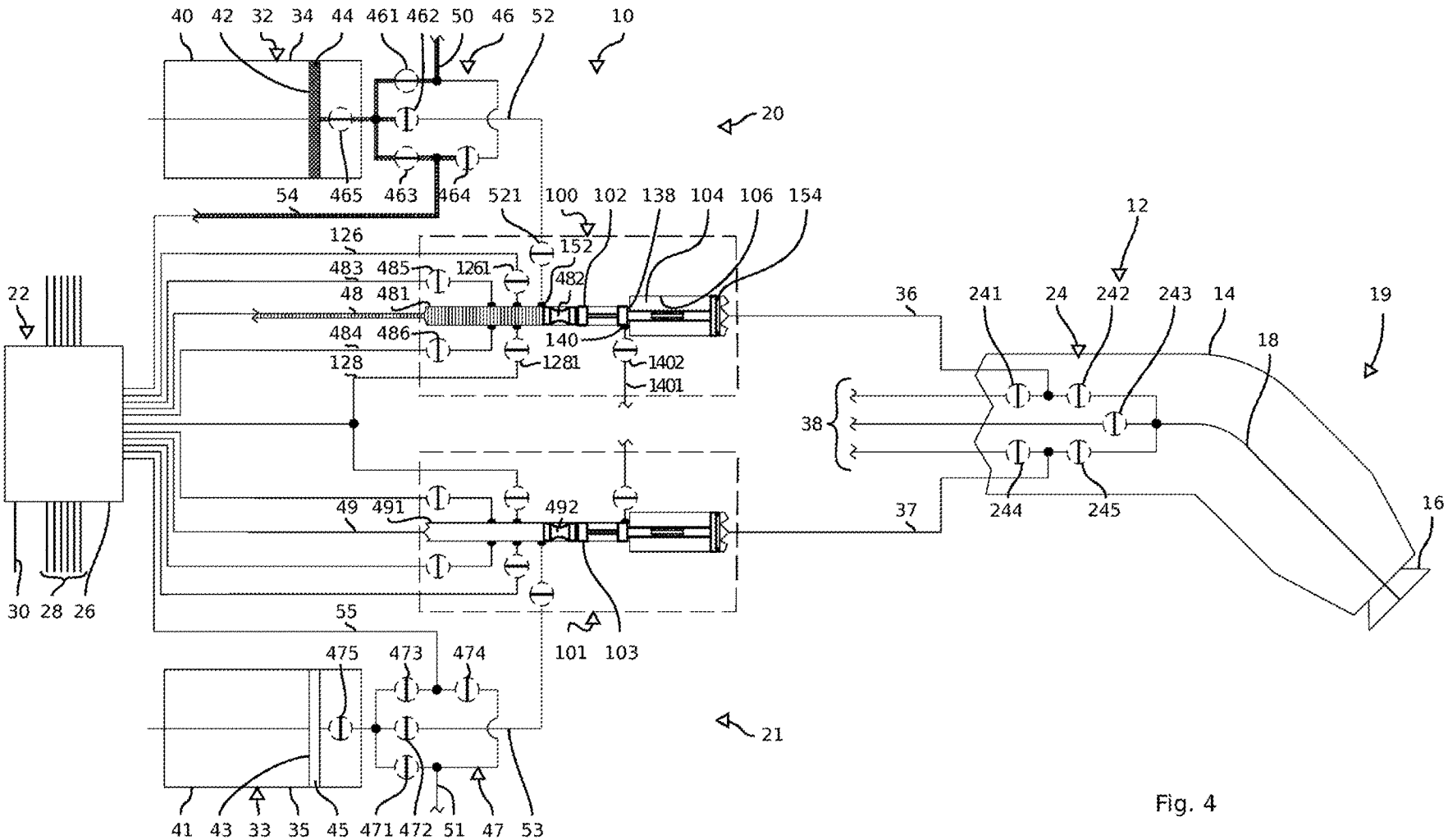

In FIG. 4, the clearing body 102 has reached its final parked position. The space 138 is now at its smallest, since the clearing body 102 has struck the stop 154 with the portion 142. The operation of filling the piston metering device 34 with detergent has been completed, the lines 50, 54, the working chamber 44 of the piston metering device 34, and the involved line portions of the metering-device valve unit 46 are blown free with compressed air. To this end, the valves 463, 465, 461 are opened.

The reaching of the parked position of the clearing body 102 frees up, in the inlet line 48 for the conveyed coating material, the access to the connection 152 which connects the insulation device 100 to the metering-device valve unit 46 and thus to the piston metering device 34 via the dispensing line 52.

Figure 5:
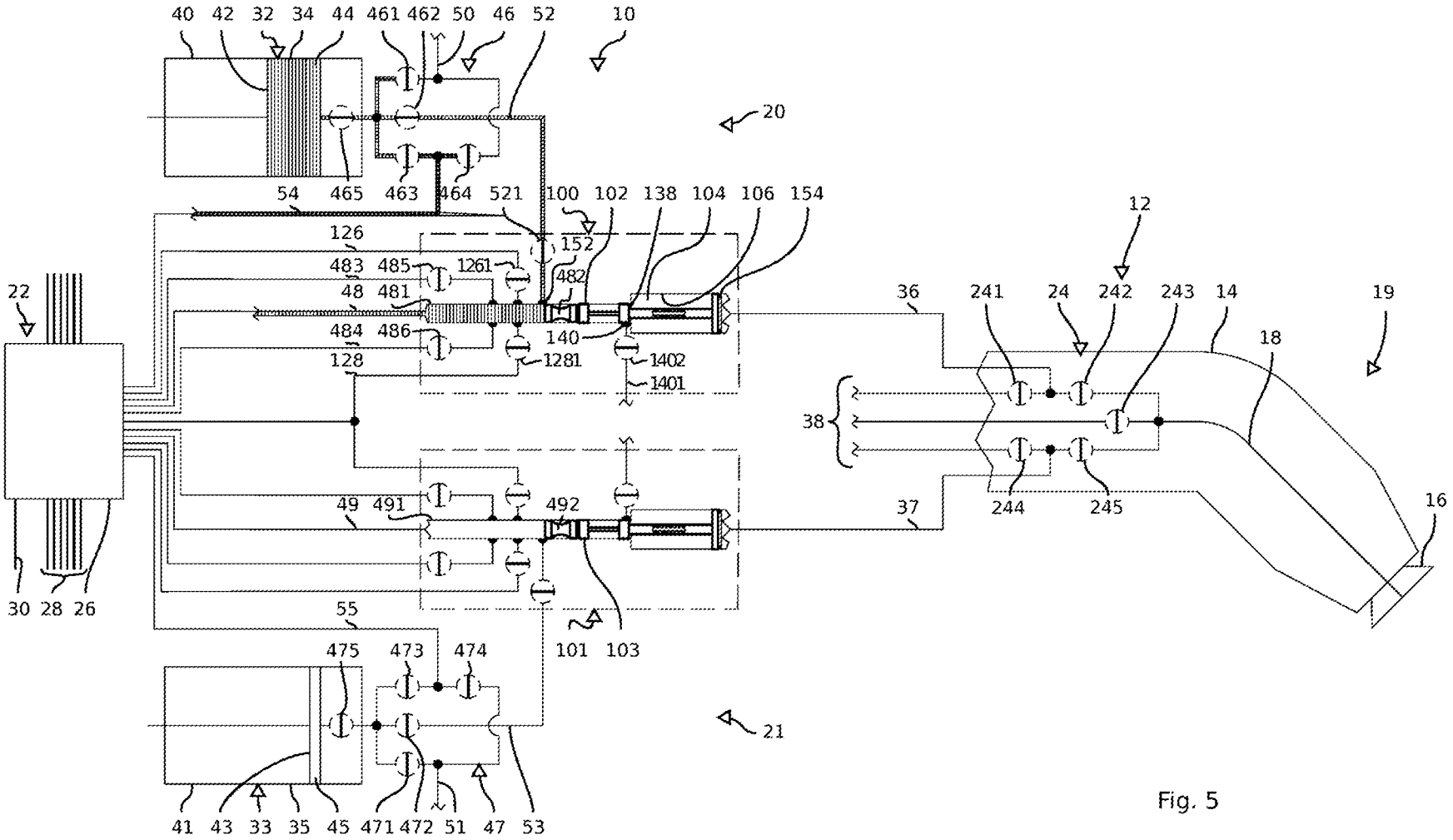

FIG. 5 illustrates how the piston metering device 34 is filled with coating material via the inlet line 48, the insulation device 100, the dispensing line 52 and the metering-device valve unit 46. To this end, the valves 461, 463 of the metering-device valve unit 46 are closed and the valves 462, 465 are opened. At the same time the valve 521 of the dispensing line 52 is likewise opened, such that the coating material can be pushed out of the dispensing line 48, in particular the piggable portion 481, and into the working chamber 44 of the piston metering device 34 via the connection 152.

Figure 6:
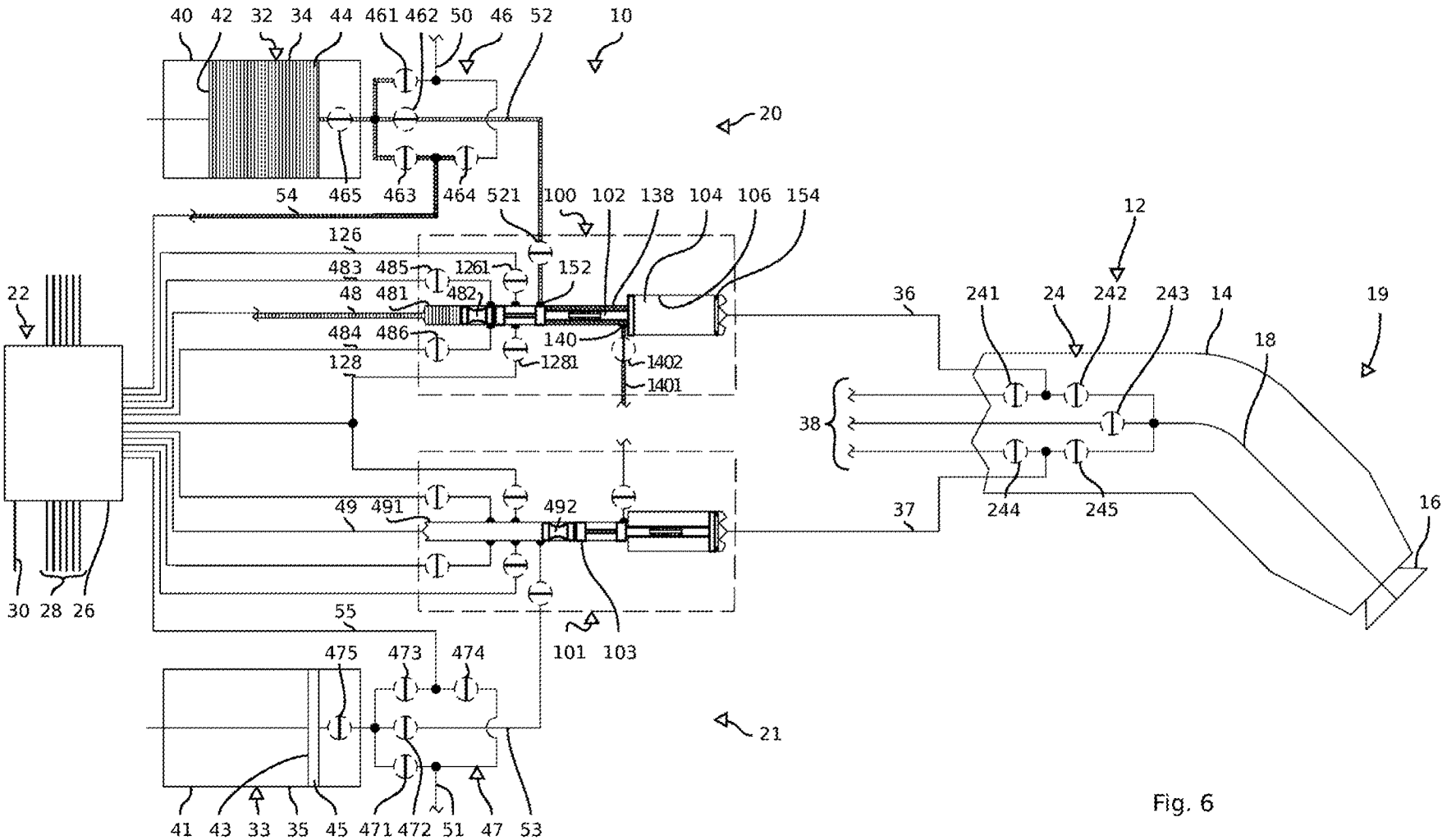

In FIG. 6, the operation of filling the piston metering device has been completed. The valve 521 of the coating-material dispensing line 52 is closed. The clearing body 102 is moved out of the parked position and into the insulation position via the working line 1401, with the valve 1402 open, by means of compressed air which is pressed into the space 138. In the process, the pig 482 is compressed in the pig line 481 together with the coating material still located in the line 48.

The position, shown in FIG. 6, of the clearing body 102 is the insulation position. By way of the insulation portion 114 of the clearing body 102 (see FIG. 2), there is now potential separation between the inlet line 48 and the working lines 126, 128, for the one part, and the piston metering device 34, the dispensing device 12 and lines connecting the piston metering device 34 and the dispensing device 12, for the other part. For a particularly good insulation effect, the insulation space 120 is usually filled permanently with an insulation medium. In the event of contamination, the insulation medium can be replaced via the connections 122, 124 and the associated working lines 126, 128. The insulation position and the contact pressure between the clearing body 102 and the color changer 26 are ensured by suitable measures.

Figure 7:
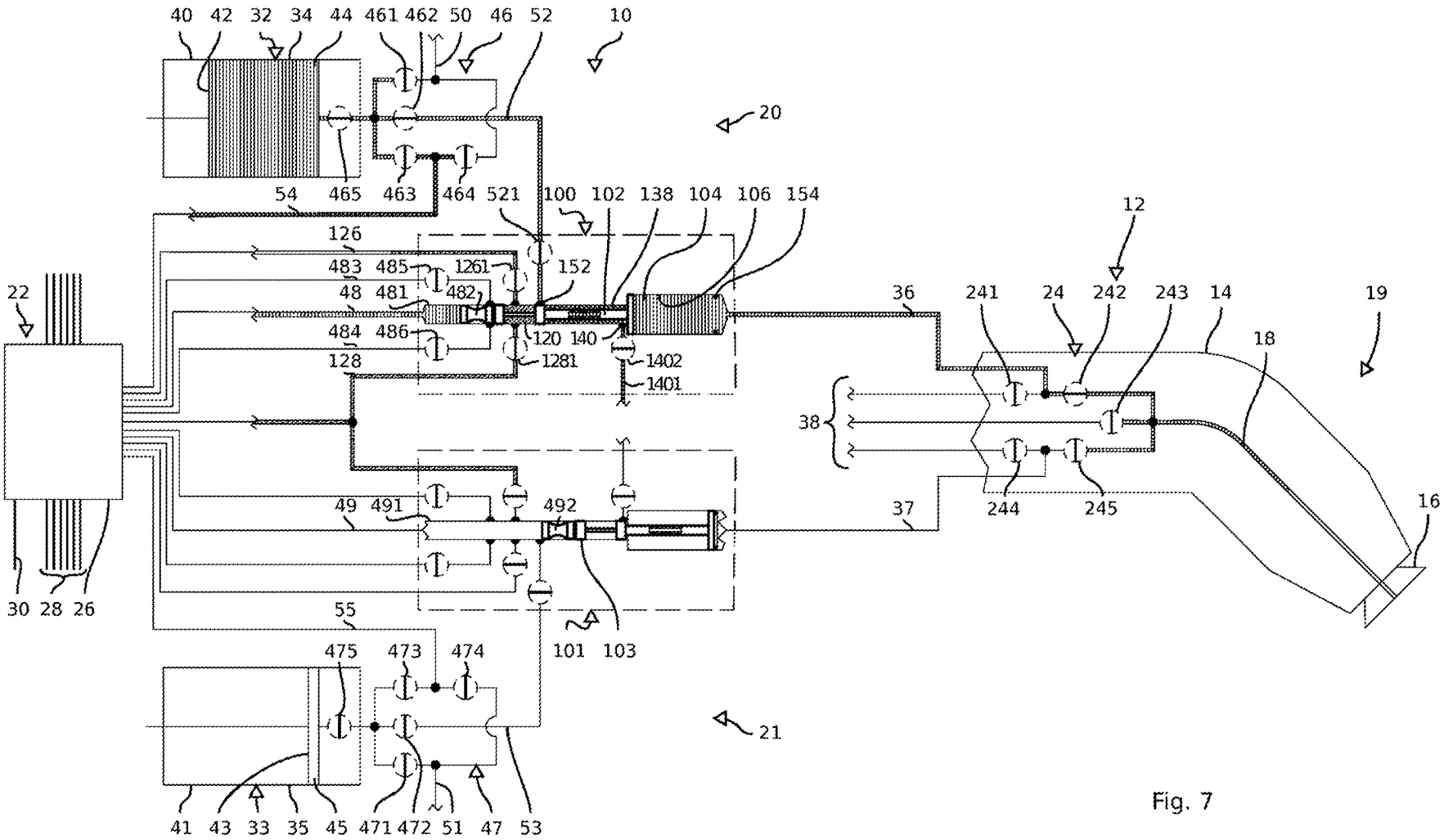

As illustrated in FIG. 7, after the insulation position of the clearing body 102 has been reached, the coating material is applied to the bell-shaped plate 16, starting from the piston metering device 34, via the metering-device valve unit 46, the coating-material dispensing line 52, the connection 152, the conduit 144, the mouth 150, the duct 104, which leads into the supply line 36 downstream of the stop 154, the output valve device 24 and the dispensing line 18. In the process, the valves 465, 462 of the metering-device valve unit 46, the valve 521 of the dispensing line 52, and the valve 242 of the output valve unit 24 are open.

At the same time, the insulation space 120 is filled with an insulation medium, unless this has already occurred. To this end, the valves 1281 and 1261 are opened, such that the insulation medium can be fed via the line 128 and excess insulation medium can be discharged via the line 126. The rest of the valves are closed.

Figure 8:
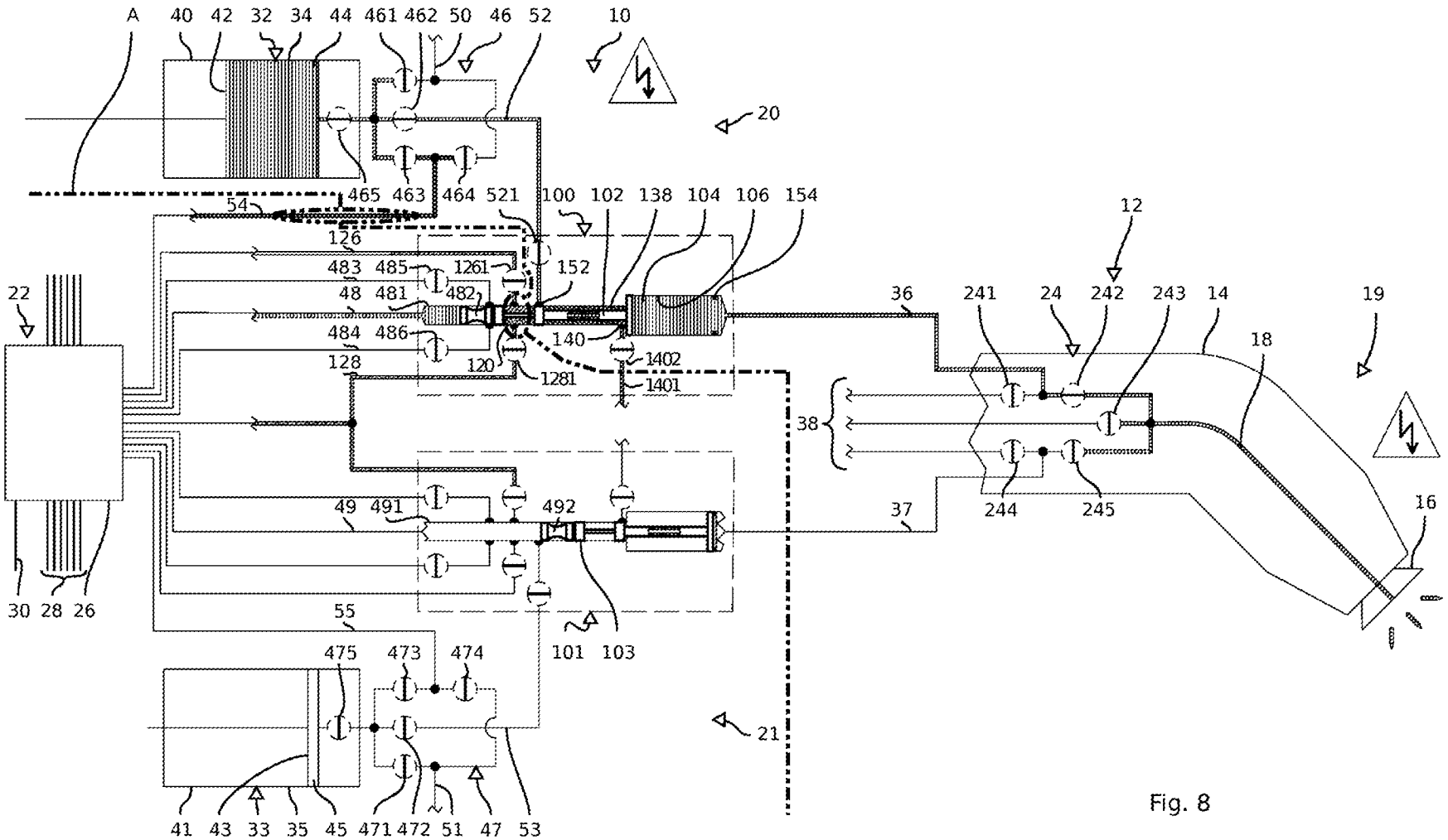

Once the operation of filling the insulation space 120 has been completed and the application has ended, the coating-material dispensing process can start. This is illustrated in FIG. 8. The valves 1281 and 1261 are closed again.

With the application of the high voltage to the dispensing device 12, those parts of the coating system 10 that are electrically connected to the dispensing device 12 are also under high voltage. These include, on account of the conductivity of the coating material, all lines that conduct coating material, and thus in particular also the piston metering device 34 and parts of the insulation device 100. The border between parts that are under high voltage and the rest of the system is indicated in FIG. 8 as a dot-dashed line A. The border extends through the still empty or already re-cleaned supply line of the second supply string 21, the empty working line 1401 of the connection 140 of the insulation device 100, the actual insulation space 120 (illustrated by an elliptical boundary), and through the emptied second working line 54, which connects the color changer 26 to the metering-device valve unit 46 (likewise illustrated by an elliptical boundary).

Figure 9:
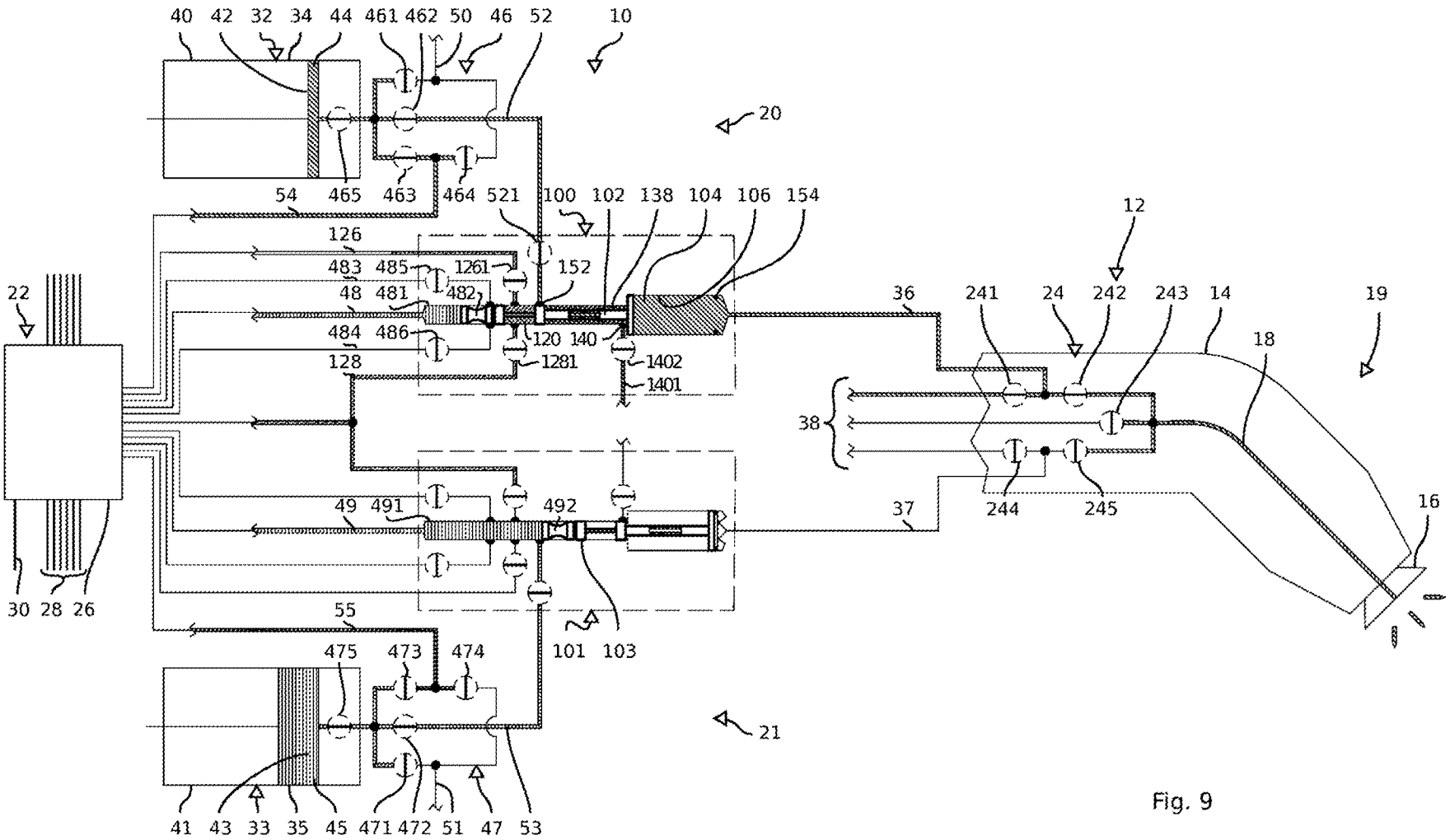

During the coating operation, filling of the piston metering device 35 can already start in parallel in the second supply string 21. This is illustrated in FIG. 9. A second coating material is already being filled into the piston metering device via the inlet line 49, the insulation device 101, the dispensing line 53 and the metering-device valve unit 47.

Following completion of the coating operation in the first supply string 20, the line system, wetted with coating material, of the first supply string 20 is flushed with detergent and the remaining coating material pushed back into the line 48. If the detergent stored in the piston metering device 34 is used for this purpose, this first flushing operation can be carried out with high voltage still applied. Subsequently, the high voltage is switched off and the paint application section, comprising the dispensing line 18, the lines and valves wetted in the output valve unit 24, the supply line 36, the duct 104 of the insulation device 100, the coating-material dispensing line 52, and the corresponding line portions of the metering-device valve unit 46 are cleaned with further addition of detergent, for example from the working lines 54, 38. For this purpose, the valves 465, 463, 462 of the metering-device valve unit 46, the valve 521 of the dispensing line 52, and the valves 241, 242 of the output valve unit 24 are opened.

Figure 10:
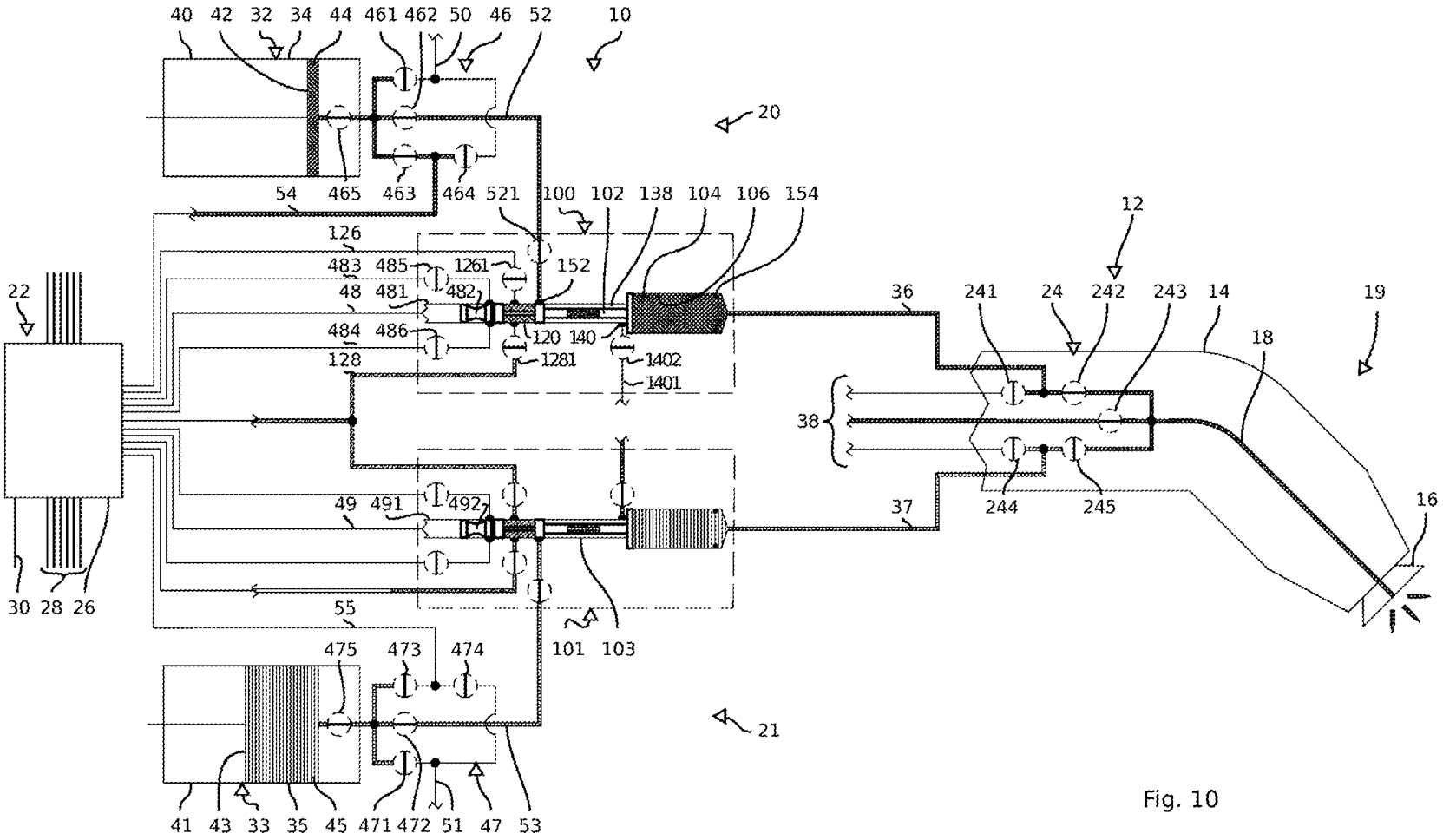

Following the flushing operation, the section, used for the earlier coating, of the supply string 20 is blown free. This is illustrated in FIG. 10. For this operation, the valves 463, 465, 462 of the metering-device valve unit 46, the valve 521 of the dispensing line 52, and the valves 242, 243 of the output valve unit 24 are opened, the valves 461, 464 of the metering-device valve unit 46, and the valves 241, 244, 245 of the output valve device 24 are closed. The compressed air can be fed or discharged for example via the lines 54, 38.

At the same time, in the second supply string 21, the operation of filling the piston metering device 35 with coating material and of filling the insulation space 121 with insulation medium has been completed. The clearing body 103 of the insulation device 101 of the second supply string 21 is already located in the insulation position and the second coating material has already been applied as far as the output valve unit 24.

Subsequently, it is possible—after the corresponding valves have been switched over and the conveying of the second coating material as far as the bell-shaped plate 16 has been completed—for high voltage to be applied again and the coating operation can be started with the second coating material from the second supply string 21.

Figure 11:
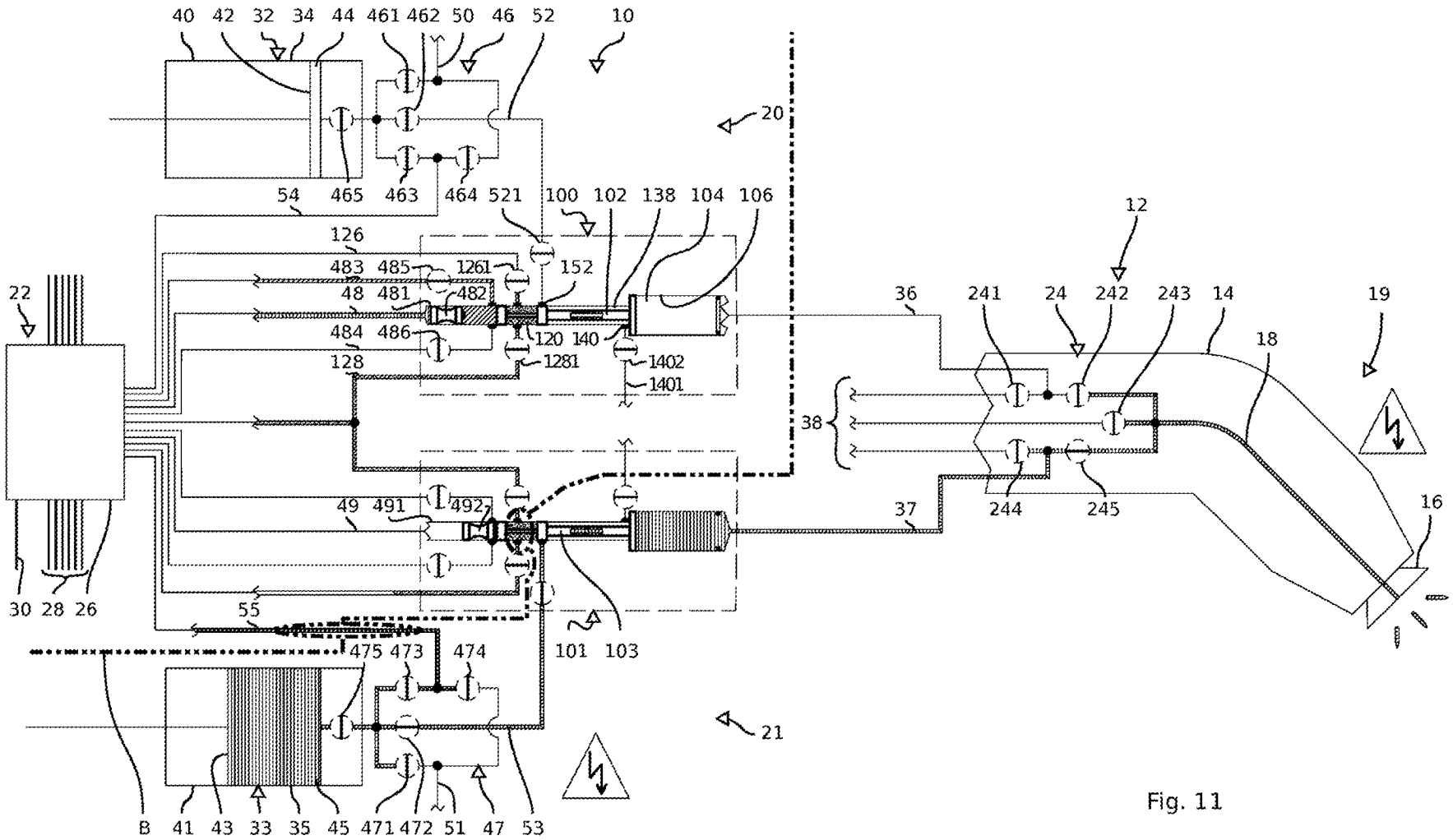

This is illustrated in FIG. 11. The potential separation, resulting from the position of the clearing body 103 in the insulation position and the emptied working line 55, of the application device 12, of those parts of the insulation device 101 that are electrically connected to the application device 12, and of the piston metering device 33, from the rest of the coating system is illustrated in FIG. 11 by means of the dot-dashed line B. The border extends through the once again emptied supply line of the first supply string 20, the empty working line of the ventilation connection of the insulation device 101 of the second supply string 21, the actual insulation space of the insulation device 101 (illustrated by an elliptical boundary) and through the emptied second working line 55 of the second supply string 21, which connects the color changer 26 to the metering-device valve unit 47 of the second supply string 21 (likewise illustrated by an elliptical boundary).

Flushing of the piggable portion 481 and optionally of the inlet line 48 can already take place in the supply string 20 during the coating operation from the supply string 21. As a result of the flushing medium being introduced via the line 483 with the valve 485 open, the pig 482 can be pushed back and the inlet line 84 cleaned.

The two-part configuration of the paint-supply system results in minor paint losses and a short color changing time on account of the mutual fillability of the supply strings 20, 21.

What is claimed is:

1. An insulation device for a coating system for coating objects, wherein the coating system comprises an electrostatically operating application apparatus having a dispensing device by means of which a coating material is able to be dispensed, and at least one feed reservoir for coating material, which is connected to an input valve device via an inlet line and to the dispensing device via a supply line, the insulation device comprising:

a duct having a clearing body that is movable in the duct, the clearing body having an electrically insulating material and being movable between a parked position and an insulation position, wherein the clearing body is configured such that, while moving from the parked position to the insulation position or from the insulation position to the parked position, the clearing body frees an inner lateral surface of the duct of material such that an electrical insulation section is able to be formed between the at least one feed reservoir and the input valve device, wherein the clearing body is movable by means of a fluid pressure, and wherein the clearing body has an insulation portion for electrical insulation and a line portion for a coating-material line so that coating material can pass through the clearing body through the coating-material line when the coating material travels from the inlet line to the supply line.

2. The insulation device of claim 1, wherein the clearing body has a longitudinal axis in a direction of movement, and the insulation portion and line portion are arranged along this longitudinal axis.

3. The insulation device of claim 1, wherein the insulation portion defines an insulation space in the duct.

4. The insulation device of claim 3, wherein the insulation space is fillable with an insulation material.

5. The insulation device of claim 1, wherein the coating-material line has a first line connection located radially with respect to the direction of movement and a second line connection located at an end side of the clearing body.

6. The insulation device of claim 5, wherein, in the insulation position, the first line connection allows a line connection between the coating-material line and the at least one feed reservoir and/or the second line connection allows a line connection between the coating-material line and the dispensing device.

7. A coating system for coating objects, comprising:

an electrostatically operating application apparatus having a dispensing device by means of which a coating material is able to be dispensed, and at least one feed reservoir for coating material, which is connected to an input valve device via an inlet line and to the dispensing device via a supply line, wherein the coating system comprises the insulation device of claim 1.

* * * * *